US009109789B2

(12) United States Patent
Uhler et al.

(10) Patent No.: US 9,109,789 B2
(45) Date of Patent: Aug. 18, 2015

(54) OMNI-DIRECTIONAL LED LAMP

(71) Applicant: Technical Consumer Products, Inc., Aurora, OH (US)

(72) Inventors: George Uhler, Wadsworth, OH (US); Timothy Chen, Aurora, OH (US)

(73) Assignee: TECHNICAL CONSUMER PRODUCTS, INC., Aurora, OH (US)

( * ) Notice: Subject to any disclaimer, the term of this patent is extended or adjusted under 35 U.S.C. 154(b) by 232 days.

(21) Appl. No.: 13/866,546

(22) Filed: Apr. 19, 2013

(65) Prior Publication Data

US 2014/0313729 A1 Oct. 23, 2014

(51) Int. Cl.

| | |
|---|---|
| ***F21V 29/00*** | (2006.01) |
| ***F21V 5/04*** | (2006.01) |
| ***F21V 17/10*** | (2006.01) |
| ***F21K 99/00*** | (2010.01) |
| ***F21V 29/74*** | (2015.01) |
| *F21V 5/00* | (2015.01) |

(52) U.S. Cl.

CPC ..... *F21V 29/2206* (2013.01); *F21K 9/135* (2013.01); *F21V 5/04* (2013.01); *F21V 29/74* (2015.01); *F21V 5/007* (2013.01); *F21V 17/104* (2013.01); *Y10T 29/49117* (2015.01)

(58) Field of Classification Search

CPC ..... F21K 9/10; F21K 9/13; F21K 9/135; F21K 9/1355; F21K 9/50; F21K 9/54; F21K 9/56; F21K 9/58; F21V 5/04; F21V 5/007; F21V 17/104; F21V 29/20; F21V 29/2206; F21V 3/00; Y10T 29/49117

USPC ..... 362/332, 360, 363; 313/45, 46

See application file for complete search history.

(56) References Cited

U.S. PATENT DOCUMENTS

| | | | | |
|---|---|---|---|---|
| 6,422,232 | B1 * | 7/2002 | Ashton et al. | 126/92 B |
| 8,314,537 | B2 * | 11/2012 | Gielen et al. | 313/46 |
| 8,414,160 | B2 * | 4/2013 | Sun et al. | 362/294 |
| 8,596,821 | B2 | 12/2013 | Brandes et al. | |
| 8,858,029 | B2 | 10/2014 | Brandes et al. | |
| 2010/0096992 | A1 | 4/2010 | Yamamoto et al. | |
| 2011/0037367 | A1 | 2/2011 | Wang et al. | |
| 2011/0089830 | A1 * | 4/2011 | Pickard et al. | 315/32 |
| 2011/0156584 | A1 * | 6/2011 | Kim | 315/32 |

(Continued)

FOREIGN PATENT DOCUMENTS

| | | |
|---|---|---|
| CN | 20194330 | 8/2011 |
| CN | 202158386 | 3/2012 |
| WO | 2013/047929 | 4/2013 |

OTHER PUBLICATIONS

PCT, International Search Report and Written Opinion, PCT/US2014/034608 (Aug. 22, 2014).

*Primary Examiner* — Alan Cariaso
(74) *Attorney, Agent, or Firm* — Thompson Hine LLP

(57) ABSTRACT

A lamp includes an LED assembly and a heat sink in thermal communication with the LED assembly. The heat sink includes a plurality of fins disposed around a body and extending away from the body. The lamp includes a plurality of lenses disposed around the body, in between the plurality of fins. A lens includes a slot disposed at the top of the lens and a protruding pin configured to engage with a hole on the heat sink. The lamp also includes a cap disposed at the top of the lamp. The cap includes a plurality of ridges configured to align with and interlock with the grooves of the plurality of lenses.

21 Claims, 7 Drawing Sheets

(56) References Cited

U.S. PATENT DOCUMENTS

2012/0026740 A1* 2/2012 Kim et al. ..... 362/294
2012/0243230 A1 9/2012 Carroll et al.
2012/0274211 A1 11/2012 Xue
2012/0326589 A1* 12/2012 Yu ..... 313/46
2013/0294069 A1* 11/2013 Udris et al. ..... 362/234
2014/0355270 A1 12/2014 Brandes et al.

* cited by examiner

OMNI-DIRECTIONAL LED LAMP

FIELD OF DISCLOSURE

The present disclosure relates to the field of lamps. More particularly, the present disclosure relates to an Omni-directional LED lamp.

BACKGROUND

Legacy lamps such as incandescent and compact fluorescent lamps are generally Omni-directional, meaning they provide patterns of light which illuminate in all directions. Such lamps are commonly used in applications where dispersion of light throughout a space is desired. Legacy lamps, however, may not be as effective and efficient as LED lamps and are therefore commonly replaced by LED lamps. Because consumers have become accustomed to lamps having certain form factors, LED replacement lamps are often designed to mimic incandescent lamps being replaced.

An LED light source, however, is more compact in size and the lumen output is more sensitive to operating temperature. An LED lamp may therefore require heat dissipating features for adequately dissipating heat to prevent the LED from overheating and failing, which a compact florescent lamp may not require. In addition, LEDs may produce patterns of light that differ from patterns of light produces by incandescent lamps. Thus, incorporating appropriate heat dissipating features as well as light distribution features into an LED lamp may result in the LED lamp having a different form factor as compared to an incandescent compact fluorescent lamp, which may not be desirable or acceptable by a consumer.

SUMMARY OF THE DISCLOSURE

A lamp includes an LED assembly and a heat sink in thermal communication with the LED assembly. The heat sink includes a plurality of fins disposed around a body and extending away from the body. The lamp includes a plurality of lenses disposed around the body, in between the plurality of fins. A lens includes a slot disposed at the top of the lens and a protruding pin configured to engage with a hole on the heat sink. The lamp also includes a cap disposed at the top of the lamp. The cap includes a plurality of ridges configured to align with and interlock with the slots of the plurality of lenses.

In a method for assembling a lamp, a plurality of cutouts of an LED assembly are aligned with a plurality of fins surrounding a base of a heat sink. The LED assembly is secured to the base. A plurality of lenses are disposed around the base, in between the plurality of fins, wherein a protruding pin at the bottom of the lens is configured to engage with a hole on the heat sink, and wherein lens grooves of the plurality of lenses are configured to align with and receive the LED assembly. The plurality of lenses are secured to the heat sink by disposing a cap at the top of the lamp, wherein a plurality of ridges of the cap are configured to align with and interlock with a plurality of slots of the plurality of lenses.

A lamp includes a heat sink. The heat sink has a base, a plurality of fins surrounding the base, and a bottom portion extending below the base. The lamp also includes a plurality of lenses disposed around the base, in between the plurality of fins, wherein the plurality of lenses is configured to conceal the base. The lamp also includes a cap disposed at the top of the lamp, wherein the cap is configured to secure the plurality of lenses to the heat sink.

BRIEF DESCRIPTION OF THE DRAWINGS

In the accompanying drawings, structures are illustrated that, together with the detailed description provided below, describe exemplary aspects of the present teachings. Like elements are identified with the same reference numerals. It should be understood that elements shown as a single component may be replaced with multiple components, and elements shown as multiple components may be replaced with a single component. The drawings are not to scale and the proportion of certain elements may be exaggerated for the purpose of illustration.

DETAILED DESCRIPTION

Figure 1A:
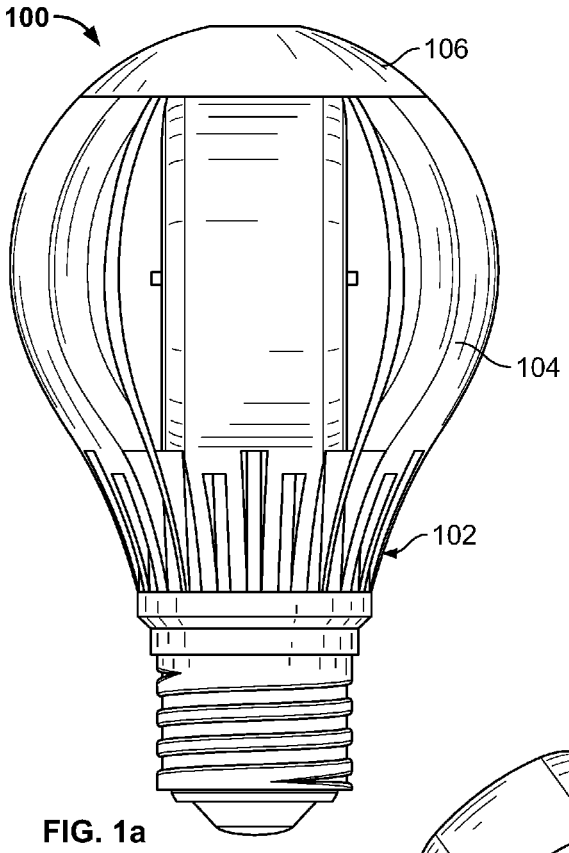
FIG. 1A illustrates a perspective view of one embodiment of an LED Omni-directional lamp.
Figure 1B:
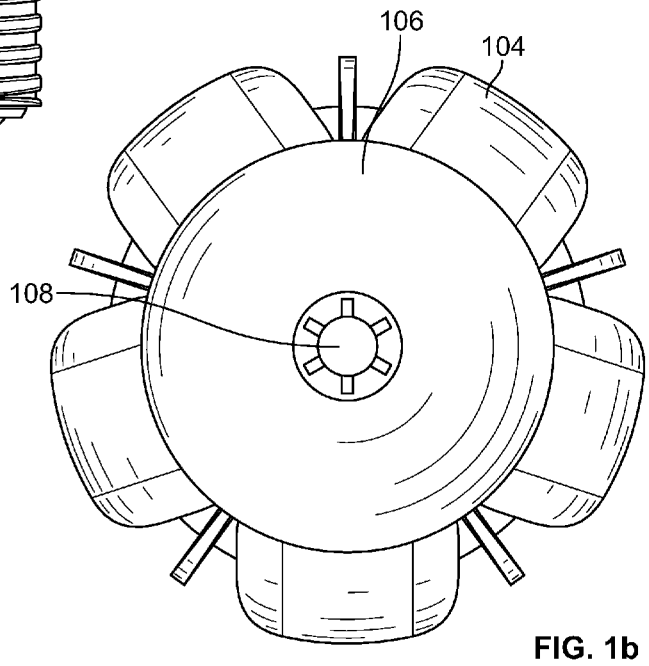
FIG. 1B is a top view of the lamp illustrated in FIG. 1A.

FIGS. 1A and 1B illustrate a perspective view and a top view, respectively, of one embodiment of an LED Omni-directional lamp 100 (hereinafter referred to as "lamp"), designed to disperse light Omni-directionally, or in all directions equally.

Figure 5:
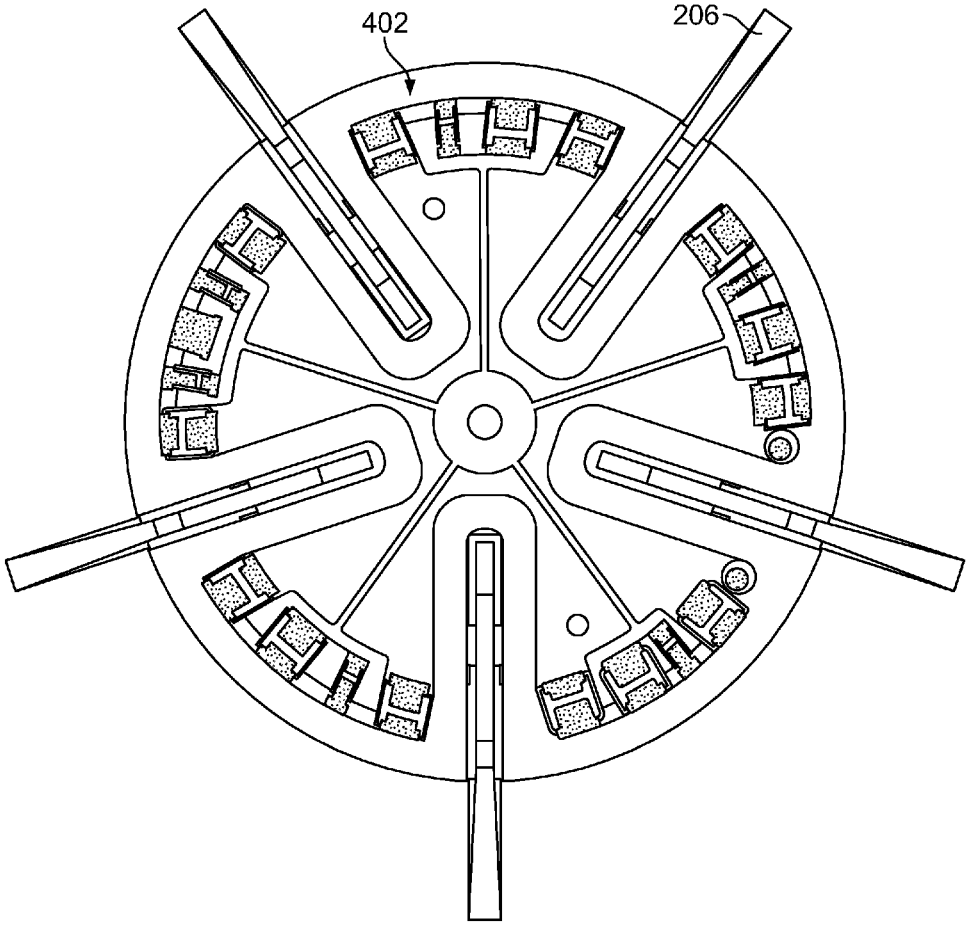
FIG. 5 is a top view of the heat sink of FIG. 2B in thermal communication with the LED assembly of FIG. 4.

Lamp 100 generally includes a heat sink 102 configured to be in thermal communication with an LED assembly, as shown in FIG. 5, lenses 104, and a cap 106.

Figure 2A:
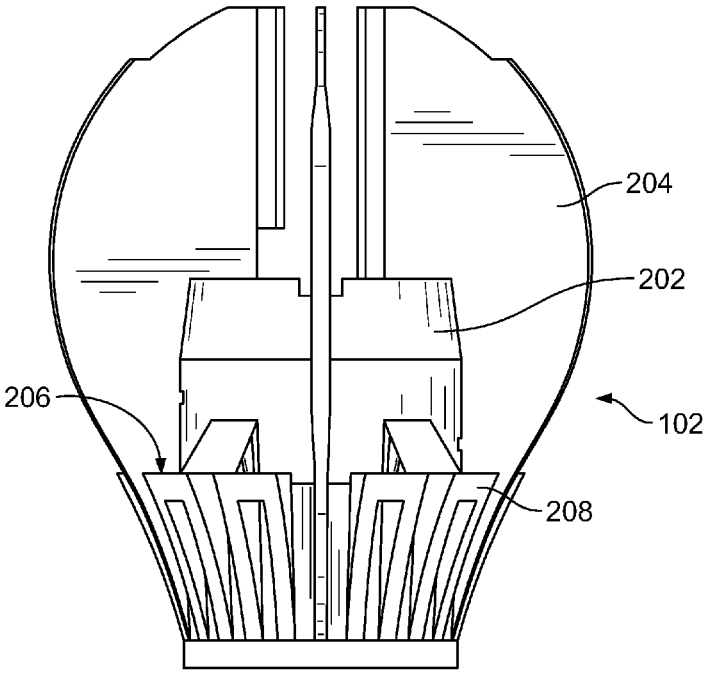
FIG. 2A is side view of an embodiment of a heat sink for use with the lamp illustrated in FIG. 1A.
Figure 2B:
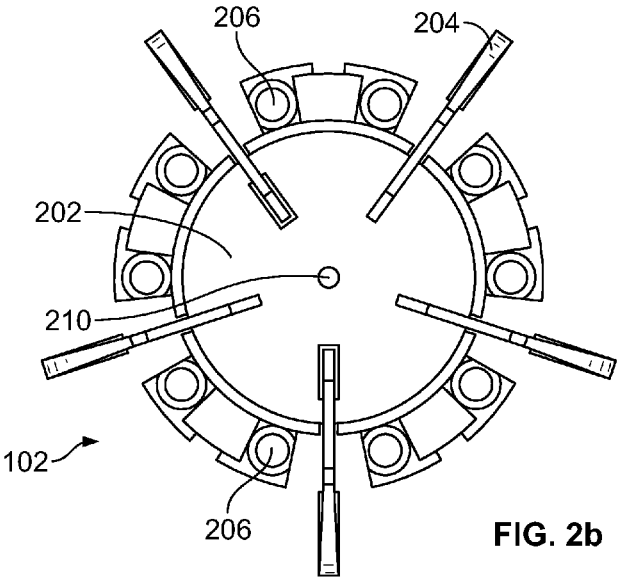
FIG. 2B is a top view of an embodiment of a heat sink for use with the lamp illustrated in FIG. 1A.

FIGS. 2A and 2B illustrates a side view and a top view, respectively, of heat sink 102, which is configured to dissipate heat away from the LED assembly and help ensure that the LED assembly functions properly while minimizing the visual impact of heat sink 102 in order to more closely mimic the visual appearance of an incandescent lamp.

Heat sink 102 has a body 202 and multiple fins 204 positioned around body 202. Fins 204 extend outward and away from, and perpendicular to, body 202. In one example, fins 204 partially overlap body 202. It should be understood that, although five fins 204 are illustrated, heat sink 102 may comprise any number of suitable fins 204. Heat sink 102 also has grooves 206, at a bottom portion 208. In one example, heat sink 102 has a threaded hole 210 for receiving mounting and fastening hardware such as a screw.

Heat sink 102 may be made or include any suitable material capable of dissipating heat, such as aluminum, copper, or a composite material. In one embodiment, heat sink 102 is made of a material, such as aluminum. In another example, heat sink 102 is coated with a light reflective paint, such as liquid or powder paints. In one embodiment, the heat sink 102 is a thermally conductive plastic.

Referring again to FIG. 1A, lamp 100 further includes lenses 104 that surround and substantially enclose or conceal body 202, thus exposing only fins 204 and a bottom portion of heat sink 102. This minimizes the visual impact of heat sink 102. It should be understood that a portion of heat sink 102 being exposed versus being surrounded by lenses 104 may be adjusted without deviating from the scope of the present application.

Lenses 104 surround body 202, in between fins 204, in an alternating manner. Lenses 104 can be constructed of any suitable material capable of dispersing light. Lenses 104 are positioned such that a space, or a gap, exists between lenses 104 and fins 204 to enable air to flow into and out from around the fins 204. The airflow helps cool lamp 100 during operating and helps lamp 100 maintain functionality, despite the reduction in visual exposure of heat sink 102.

Figure 3A:
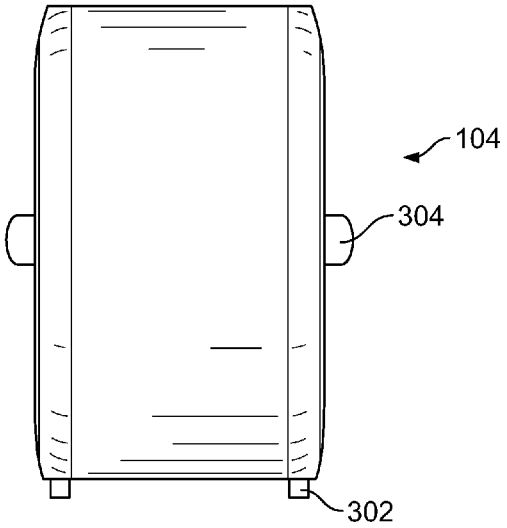
FIG. 3A is a side view of an embodiment of a lens for use with the lamp illustrated in FIG. 1A.
Figure 3B:
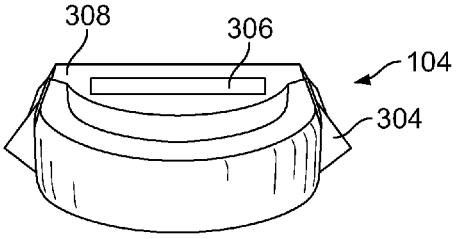
FIG. 3B is a top view of an embodiment of a lens for use with the lamp illustrated in FIG. 1A.
Figure 3C:
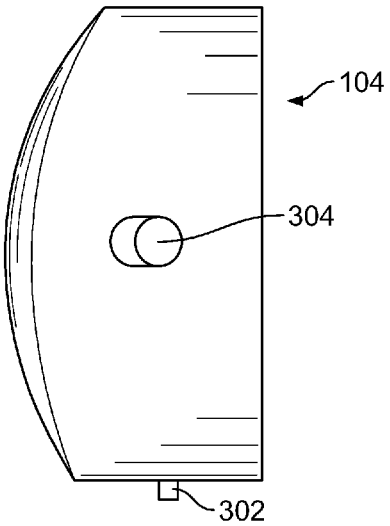
FIG. 3C is a side view of an embodiment of a lens for use with the lamp illustrated in FIG. 1A.

FIGS. 3A, 3B, and 3C illustrate front, top, and side views, respectively, of a lens 104. Lens 104 has one or more protruding pins 302 configured to engage with holes 206 on heat sink 102. In one example, pins 302 protrude from the bottom of lens 104. Pins 302 help align lenses 104 with heat sink 102 during assembly. In one example, pins 302 also help secure lenses to heat sink 102 after assembly is complete. Pins 302 can be any shape or thickness, designed to correspond to the shape of holes 206. It should be understood that, although lens 104 is illustrated as having two pins 302, a lens may also include a single pin 302 or more than two pins 302.

Lens 104 also has a lens slot 306 in a folded over portion 308 at the top of lens 104. Lens 104 also is curved or folded at the sides. This enables lens 104 to make flush contact with heat sink 102 and to visually encapsulate a greater portion of heat sink 104 while at the same time allowing fins 204 to extend outward in between lenses 104 to dissipate heat away from lamp 100.

A lens 104 also has a center groove 304 to further help align lens when assembling lamp 100 and also to prevent lens 104 from shifting vertically after installation is complete. In one example, center groove 304 aligns with and receives an LED assembly (not shown) secured to heat sink 102.

Figure 4:
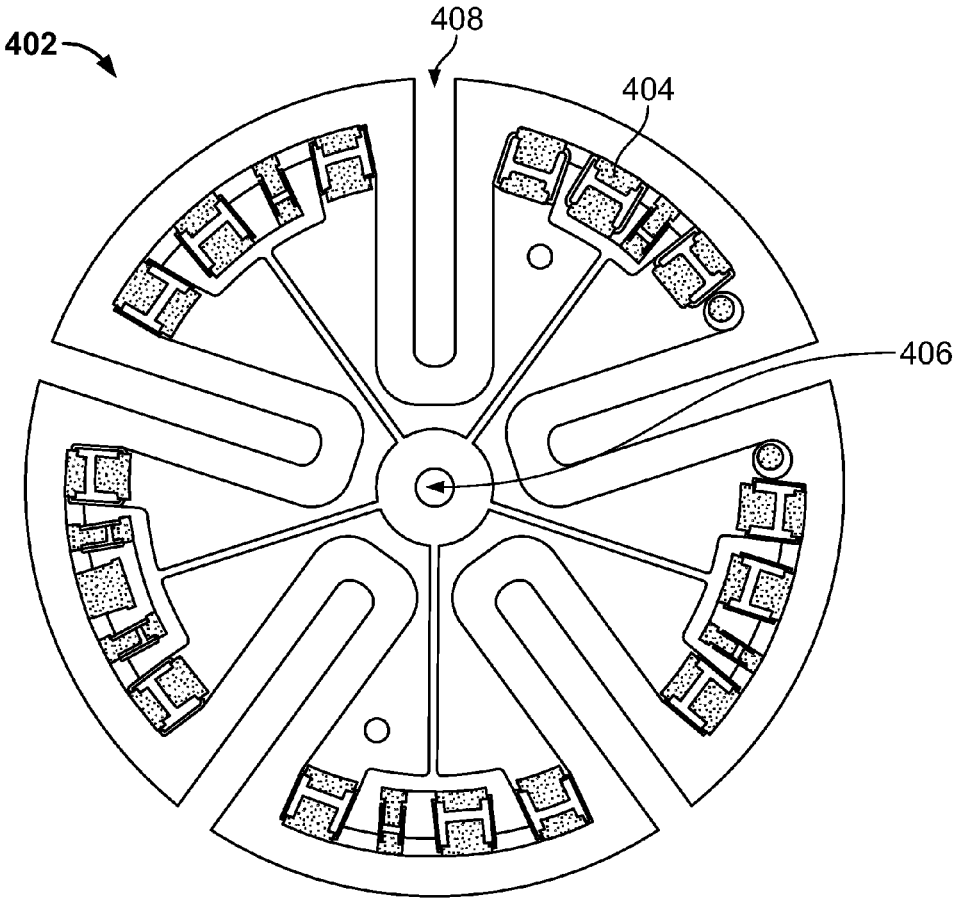
FIG. 4 is a top view an embodiment of an LED assembly for use with the lamp of FIG. 1A.

FIG. 4 shows one embodiment of an LED assembly 402 included in lamp 100. LED assembly 402 includes LEDs 404 for producing downward and upward light of lamp 100. LED assembly 402 has a mounting hole 406 that aligns with thru holes 210 of heat sink 102. LED assembly 402 also has cutouts 408 that correspond to and align with the fins 206 of heat sink 102. Accordingly, in one example, LED assembly 402 is designed to slide down onto heat sink 102, in between fins 206, and be secured to the top of body 202 as illustrated in FIG. 5.

Figure 8:
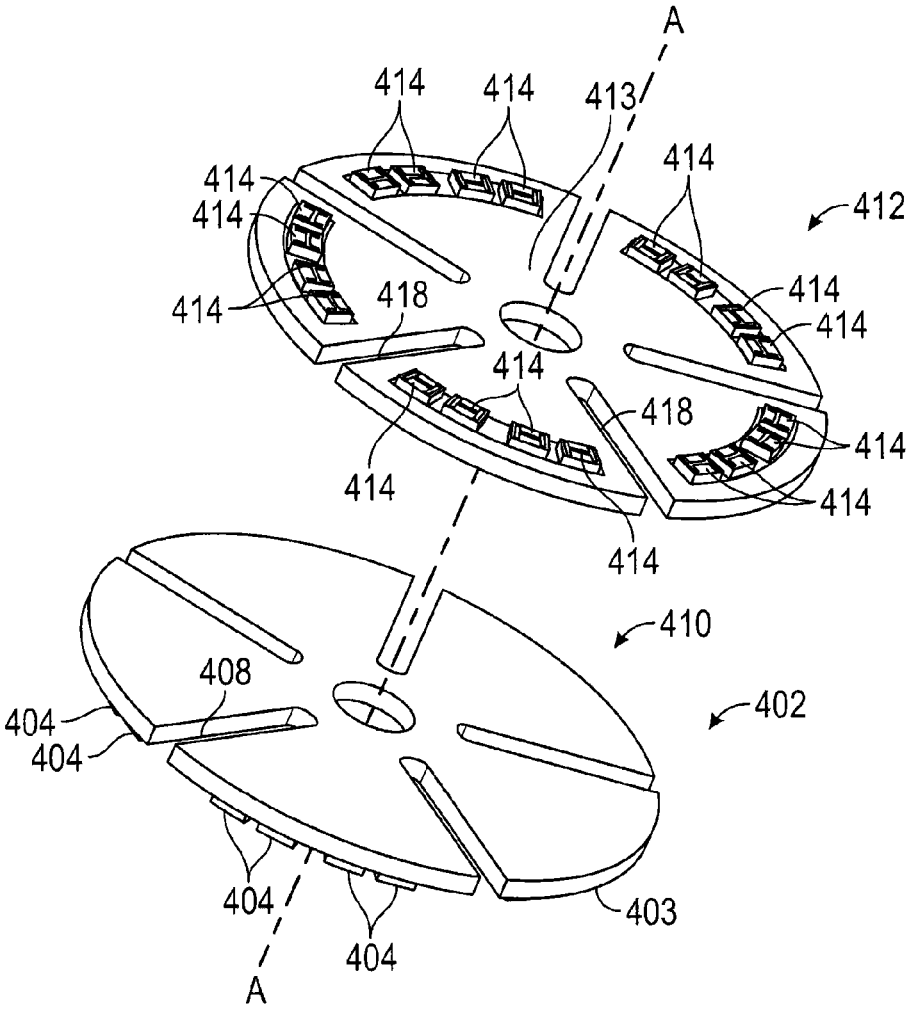
FIG. 8 is an exploded view of two LED assemblies.
Figure 9:
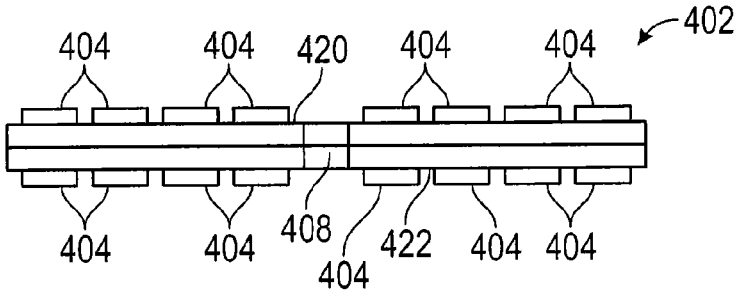
FIG. 9 is a side of an LED assembly with LEDs disposed along a top side and a bottom side.

It should be understood that lamp 100 may include two or more LED assemblies 402. For example, turning now to FIG. 8, an exploded view of the LED assembly 402 as well as a second LED assembly 412, which includes similar cutouts 418 that align with the cutouts 408 of the LED assembly 402 is illustrated. As seen in FIG. 8, the LED assembly 402 and the second LED assembly 412 are both aligned along a longitudinal axis A-A of the lamp 100 (the lamp 100 is illustrated in FIG. 1). Referring to FIGS. 2*a*, 4 and 8, the second LED assembly 412 is secured to body 202, parallel to the LED assembly 402, but is inverted so that a plurality of LEDs 404 disposed along an upper surface 403 of the LED assembly 402 and a plurality of LEDs 414 disposed along an upper surface 413 of the second LED assembly 412 face opposite directions. In other words, the plurality of LEDs 404 of the first LED assembly 402 may face toward the bottom of lamp 100, while the plurality of LEDs 414 of the second LED assembly 412 face toward the top of lamp 100. FIG. 9 is an alternative illustration of the LED assembly 402. In this embodiment, the LED assembly 402 may be doable sided, including LEDs 404 positioned on both a top side 420 of LED assembly 402 and on a bottom side 422 of LED assembly 402. In one example LEDs 404 may be mounted vertically on LED assembly 402. This enables the stacking of three or more LED assemblies on top of each other within lamp 100.

Turning back to FIGS. 1-5, it should be understood that, although the figures illustrate a thru hole 210 and a mounting hole 406 positioned in the center of heat sink 102 and LED assembly 402, thru hole 210 and mounting hole 406 may be positioned in any suitable location. For example, LED assembly 402 may be secured vertically to fin 206 of heat sink 102. Accordingly, fin 206 may be configured with a threaded hole. In one example, lamp 100 may include multiple LED assemblies 402 secured to respective fins 206. Additionally, heat sink 102 and LED assembly 402 may include multiple corresponding threaded and mounting holes.

Referring back to FIG. 1A, lamp 100 further includes a cap 106 configured to secure lenses 104 in place and prevent lenses 104 from moving horizontally after assembly is complete. Cap 106 may include an opening 108, or a vent, to allow additional air to flow into and out of lamp 100 for cooling purposes.

Figure 6:
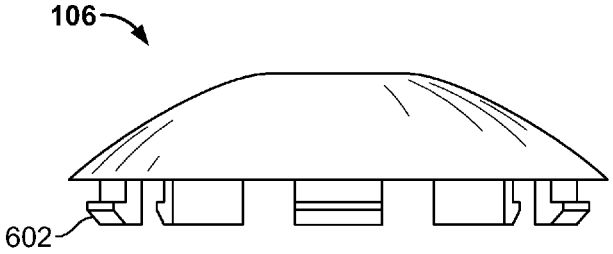
FIG. 6 is a side view of an embodiment of a cap for use with the lamp illustrated in FIG. 1A.

FIG. 6 illustrates a side view of cap 106. Cap 106 includes cap ridges 602 extending downward from the bottom of cap 106. Cap ridges 602 are configured to align with, slide into, and interlock with lens slots 306. Thus, the combination of the cap ridges 602 interlocking with lens slots 306 and center grooves 304 aligning with and receiving an LED assembly secured to heat sink 102 ensures a secure lamp 100 assembly while maintaining an efficient assembly process since no adhesive is required.

Figure 7:
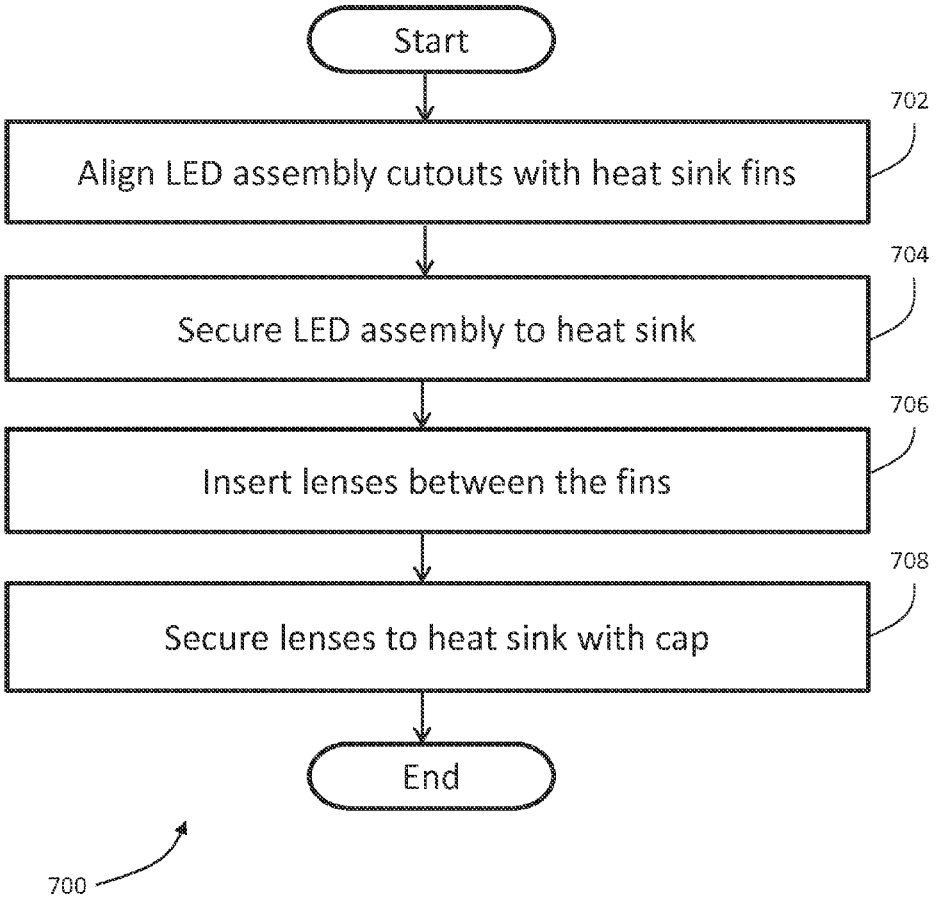
FIG. 7 is a flow chart illustrating a method for assembling an LED Omni-directional lamp.

FIG. 7 illustrates a flow chart for a method for assembling an example lamp 100 according to one exemplary aspect of the present application. At step 702, a plurality of cutouts of an LED assembly are aligned with a plurality of fins 206 surrounding the body, or base, of a heat sink. At step 704, the LED assembly is slid down onto the base by pushing the fins of the heat sink through the cutouts of the LED assembly and securing the LED assembly to the base. At step 706, a number of lenses corresponding to the number of spaces between fins are inserted around the base, in between the fins. The lenses are put in place by aligning pins protruding from the bottom of the lenses with holes in the heat sink and inserting the protruding pins into the holes. The lenses are then pushed forward toward the LED assembly by aligning lens grooves in the middle of the lenses with the LED assembly and engaging the lens grooves with the LED assembly. At step 708, the lenses are secured to the heat sink by positioning a cap at the top of the lamp. The lamp has a number of ridges protruding downward. As the cap is lowered down onto the lamp, the ridges are aligned with and interlock with slots of the lenses.

To the extent that the term "includes" or "including" is used in the specification or the claims, it is intended to be inclusive in a manner similar to the term "comprising" as that term is interpreted when employed as a transitional word in a claim. Furthermore, to the extent that the term "or" is employed (e.g., A or B) it is intended to mean "A or B or both." When the applicants intend to indicate "only A or B but not both" then the term "only A or B but not both" will be employed. Thus, use of the term "or" herein is the inclusive, and not the exclusive use. See, Bryan A. Garner, A Dictionary of Modern Legal Usage 624 (2d. Ed. 1995). Also, to the extent that the terms "in" or "into" are used in the specification or the claims, it is intended to additionally mean "on" or "onto." Furthermore, to the extent the term "connect" is used in the specification or claims, it is intended to mean not only "directly connected to," but also "indirectly connected to" such as connected through another component or components.

While the present application has been illustrated by the description of example aspects of the present disclosure thereof, and while the example aspects have been described in considerable detail, it is not the intention of the applicants to restrict or in any way limit the scope of the appended claims to such detail. Additional advantages and modifications will readily appear to those skilled in the art. Therefore, the application, in its broader aspects, is not limited to the specific details, the representative apparatus and method, and illustrative examples shown and described. Accordingly, departures may be made from such details without departing from the spirit or scope of the applicant's general inventive concept.

What is claimed is:

1. A lamp comprising:

a LED assembly;

a heat sink in thermal communication with the LED assembly, the heat sink comprising a plurality of fins disposed around a body and extending away from the body;

a plurality of lenses disposed around the body, in between the plurality of fins such that a space is defined between each one of the lenses and each one of the fins to allow for air to flow into and out of the lamp, wherein a lens comprises:

a slot disposed at the top of the lens; and a protruding pin configured to engage with a hole on the heat sink; and a cap disposed at the top of the lamp, the cap comprising a plurality of ridges configured to align with and interlock with the slots of the plurality of lenses.

2. The lamp of claim 1, wherein the LED assembly is secured to the top of the body, wherein the LED assembly comprises a plurality of cutouts configured to align with the plurality of fins, and wherein the lens have a groove configured to align with and receive the LED assembly.

3. The lamp of claim 2, further comprising a second LED assembly disposed substantially parallel to the LED assembly, wherein the second LED assembly comprises a plurality of cutouts configured to align with the plurality of fins.

4. The lamp of claim 3, wherein a plurality of LEDs disposed on a surface of the LED assembly face a direction opposite a plurality of LEDs disposed on a surface of the second LED assembly.

5. The lamp of claim 4, wherein the plurality of LEDs of the LED assembly face towards the bottom of the lamp and the LEDs of the second LED assembly face towards the top of the lamp.

6. The lamp of claim 1, wherein the LED assembly is double sided, wherein a plurality of LEDs disposed on a first surface of the LED assembly face a direction opposite a plurality of LEDs disposed on a second surface of the LED assembly.

7. The lamp of claim 1, wherein the LED assembly is secured to one of the plurality of fins and is disposed with respect to a longitudinal axis of the lamp.

8. The lamp of claim 7, further comprising a second LED assembly secured to another one of the plurality of fins and is disposed with respect to a longitudinal axis of the lamp.

9. The lamp of claim 1, wherein the plurality of lenses disposed around the body, in between the plurality of fins, are configured to allow airflow between the plurality of lenses and the plurality of fins.

10. The lamp of claim 1, wherein the cap further comprises an opening configured to allow airflow to the heat sink.

11. The lamp of claim 1, wherein the heat sink is reflective.

12. A method for assembling a lamp, comprising the steps of:

aligning a plurality of cutouts of an LED assembly with a plurality of fins surrounding a base of a heat sink;

securing the LED assembly to the base;

disposing a plurality of lenses around the base, in between the plurality of fins such that a space is defined between each one of the lenses and each one of the fins to allow for air to flow into and out of the lamp, wherein a protruding pin at the bottom of the lens is configured to engage with a hole on the heat sink, and wherein lens grooves of the plurality of lenses are configured to align with and receive the LED assembly; and securing the plurality of lenses to the heat sink by disposing a cap at the top of the lamp, wherein a plurality of ridges of the cap are configured to align with and interlock with a plurality of slots of the plurality of lenses.

13. The method of claim 12, wherein the step of securing the LED assembly to the base comprises inserting a screw through an opening in the LED assembly and into a thru hole in the top of the base.

14. The method of claim 12, further comprising the step of coating the heat sink with a reflective layer.

15. The method of claim 12, further comprising the steps of:

aligning a plurality of cutouts of a second LED assembly with the plurality of fins surrounding the base; and securing the second LED assembly to the base.

16. The method of claim 12, further comprising the steps of securing a second LED assembly to one of the plurality of fins.

17. The method of claim 12, wherein the step of disposing a plurality of lenses around the base, in between the plurality of fins, comprises creating a space for airflow between the plurality of lenses and the plurality of fins.

18. The method of claim 12, wherein the step of securing the plurality of lenses to the heat sink by disposing a cap at the top of the lamp comprises creating a space for airflow between the cap and the plurality of lenses.

19. A lamp comprising:

a heat sink comprising:

a base;

a plurality of fins surrounding the base; and a bottom portion extending below the base;

a plurality of lenses disposed around the base, in between the plurality of fins a plurality of lenses disposed around the body, in between the plurality of fins such that a space is defined between each one of the lenses and each one of the fins to allow for air to flow into and out of the lamp, wherein the plurality of lenses are configured to conceal the base; and a cap disposed at the top of the lamp, wherein the cap is configured to secure the plurality of lenses to the heat sink.

20. The lamp of claim 19, further comprising a plurality of LED assemblies in thermal communication with the heat sink.

21. The lamp of claim 19, wherein the cap defines an opening for allowing airflow through the lamp.

* * * * *